US006238549B1

(12) United States Patent
Viltard et al.

(10) Patent No.: US 6,238,549 B1
(45) Date of Patent: May 29, 2001

(54) PROCESS FOR CONVERTING HYDROCARBONS BY TREATMENT IN A DISTILLATION ZONE ASSOCIATED WITH A REACTION ZONE, COMPRISING RE-CONTACTING A VAPOR DISTILLATE WITH THE FEED, AND ITS USE FOR HYDROGENATING BENZINE

(75) Inventors: Jean-Charles Viltard, Vienne; Jean-Louis Ambrosino, Ternay; Blaise Didillon, Rueil-Malmaison, all of (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 0 days.

(21) Appl. No.: 09/459,874

(22) Filed: Dec. 14, 1999

(30) Foreign Application Priority Data

Dec. 14, 1998 (FR) ..... 98 15791

(51) Int. Cl.[7] ..... C10G 7/00; C10G 45/44; C07C 5/10

(52) U.S. Cl. ..... 208/93; 208/92; 208/145; 208/347; 585/263; 585/266

(58) Field of Search ..... 208/46, 92, 93, 208/144, 145, 347

(56) References Cited

U.S. PATENT DOCUMENTS 4,673,488 * 6/1987 Turner et al. ..... 208/101
4,889,545 * 12/1989 Campbell et al. ..... 62/24
5,905,182 * 5/1999 Streicher et al. ..... 585/804
5,948,948 * 9/1999 Lebas et al. ..... 585/739

FOREIGN PATENT DOCUMENTS 0 781 830 7/1997 (EP) .

* cited by examiner

*Primary Examiner*—Bekir L. Yildirim
(74) *Attorney, Agent, or Firm*—Millen, White, Zelano & Branigan, P.C.

(57) ABSTRACT

The invention concerns a process for converting a hydrocarbon feed in which said feed is treated in a distillation zone producing an overhead vapor distillate and a bottom effluent, associated with an at least partially external reaction zone comprising at least one catalytic bed, in which at least one reaction for converting at least a portion of at least one hydrocarbon is carried out in the presence of a catalyst and a gas stream comprising hydrogen, the feed for the reaction zone being drawn off at the height of at least one draw-off level and representing at least a portion of the liquid flowing in the distillation zone, at least part of the effluent from the reaction zone being re-introduced into the distillation zone at the height of at least one re-introduction level, so as to ensure continuity of the distillation, said process being characterized in that at least a portion of the vapor distillate is re-contacted with at least a portion of the feed introduced into the distillation zone. This process can be used to reduce the benzene content in a hydrocarbon cut.

16 Claims, 2 Drawing Sheets

PROCESS FOR CONVERTING HYDROCARBONS BY TREATMENT IN A DISTILLATION ZONE ASSOCIATED WITH A REACTION ZONE, COMPRISING RE-CONTACTING A VAPOR DISTILLATE WITH THE FEED, AND ITS USE FOR HYDROGENATING BENZINE

BACKGROUND OF THE INVENTION

1. Field of the Invention

The invention relates to a process for converting hydrocarbons. The process of the invention associates a distillation zone with a reaction zone for hydrocarbon conversion which is at least partially external to the distillation zone into which an effluent comprising hydrogen is introduced. Thus this process can selectively convert hydrocarbons separated from a hydrocarbon feed by means of the distillation zone, in a reaction zone associated with withdrawing the feed for the reaction zone from the distillation zone and re-introducing the converted feed into the distillation zone.

More particularly, the process of the invention is applicable to selective reduction of the quantity of light unsaturated compounds (i.e., containing at most six carbon atoms per molecule) comprising benzene and possibly olefins in a hydrocarbon cut essentially comprising at least 5 carbon atoms per molecule, with no substantial loss of octane number.

2. Description of the Prior Art

The general trend now is to reduce the quantity of benzenes and olefins (unsaturated compounds) in gasolines, because of their known toxicity.

Benzene has carcinogenic properties and thus the possibility of it polluting the air must be limited as far as possible, in particular by practically excluding it from automobile fuels. In the United States, reformulated fuels must not contain more than 1% by volume of benzene; in Europe, it has been recommended that a gradual decrease towards that value be made.

Olefins are known to be among the most reactive hydrocarbons in photochemical reactions with oxides of nitrogen, which occur in the atmosphere and which lead to the formation of ozone. A rise in the concentration of ozone in the air may be a source of respiratory problems. It is thus desirable to reduce the amount of olefins in gasolines, and more particularly of the lightest olefins which have the greatest tendency to vaporize when handling a fuel.

The benzene content of a gasoline is very largely dependent on that of the reformate component in that gasoline. The reformate results from catalytic treatment of naphtha intended to produce aromatic hydrocarbons, principally comprising 6 to 9 carbon atoms per molecule and the octane number of which is very high endowing the gasoline with antiknock properties.

Because of the toxicity described above, the amount of benzene in the reformate must be reduced by a maximum.

The benzene in a reformate can be hydrogenated to cyclohexane. Since it is impossible to selectively hydrogenate benzene in a mixture of hydrocarbons also containing toluene and xylenes, that mixture must first be fractionated to isolate a cut containing only benzene, which can then be hydrogenated.

International patent application WO 95/15934 describes a reactive distillation which aims to selectively hydrogenate diolefins and C2–C5 acetylenic compounds. The catalytic hydrogenation zone is completely internal to the distillation column, which means that the hydrogen cannot dissolve properly in the feed and the pressure cannot be increased.

A number of processes have been described in which the catalytic benzene hydrogenation zone is internal to the distillation column which separates benzene from other aromatic compounds, which cuts the cost of the apparatus. Such a process has been described in U.S. Pat. Nos. 4,232,177, 4,307,254, 4,336,407, 3,629,478, 4,471,154 and 3,629,478. It appears that the pressure drop across the catalytic bed(s) in that process means that an intimate mixture between the liquid phase and the gas stream containing the hydrogen cannot be obtained. In that type of technology where the reaction and distillation proceed simultaneously in the same physical space, the liquid phase descends through every catalytic bed in the reaction zone in a trickle flow, and thus in threads of liquid. The gaseous fraction containing the fraction of vaporized feed and the gas stream containing hydrogen rise through the catalytic bed in columns of gas. In that arrangement, the entropy of the system is high and the pressure drop across the catalytic bed(s) is low. As a result, operating using that type of technique does not enable hydrogen to dissolve readily in the liquid phase comprising the unsaturated compound(s).

A number of processes have been described in which the reaction zone is external to the distillation column with withdrawal of the feed to be converted from one level in the column and re-introduction of the converted effluent into the column. Such a process has been described in U.S. Pat. No. 4,503,265 and in International applications WO 93/19031, WO 93/19032 and WO 94/13599 for application to alkylether synthesis. Similarly, U.S. Pat. No. 5, 177, 283 describes this technique for aromatic hydrocarbon alkylation.

The Applicant's European patent application EP-A-0 781 830 describes a process for hydrogenating benzene using a distillation column associated with a reaction zone which is at least partially external. The effluent is recovered overhead from the column, then arrives in a drum via a condenser from which drum the desired liquid product is recovered and it is observed that certain losses of hydrocarbon compounds can occur, in particular a loss of compounds containing 5 carbon atoms.

SUMMARY OF THE INVENTION

The process of the present invention is an improvement over the Applicant's patent application EP-A-0 781 830, the features of which are hereby included in the present description.

The invention provides a process for converting a hydrocarbon feed associating a distillation zone producing a vapor distillate and a bottom effluent, and a reaction zone which is at least partially external to the distillation zone. At least one reaction for converting at least a portion of at least one hydrocarbon takes place in a reaction zone comprising at least one catalytic bed in the presence of at least one catalyst and a gas stream comprising hydrogen. The feed for the reaction zone is drawn off from the distillation zone at the height of at least one draw-off level and represents at least a portion of the liquid flowing in the distillation zone, and at least a portion of the effluent from the reaction zone is re-introduced into the distillation zone at the height of at least one re-introduction level, so as to ensure continuity of distillation. The invention is characterized in that at least a portion of the vapor distillate is brought into contact with at least a portion of the feed introduced into the distillation zone.

DESCRIPTION OF THE PREFERRED EMBODIMENTS

Figure 1:
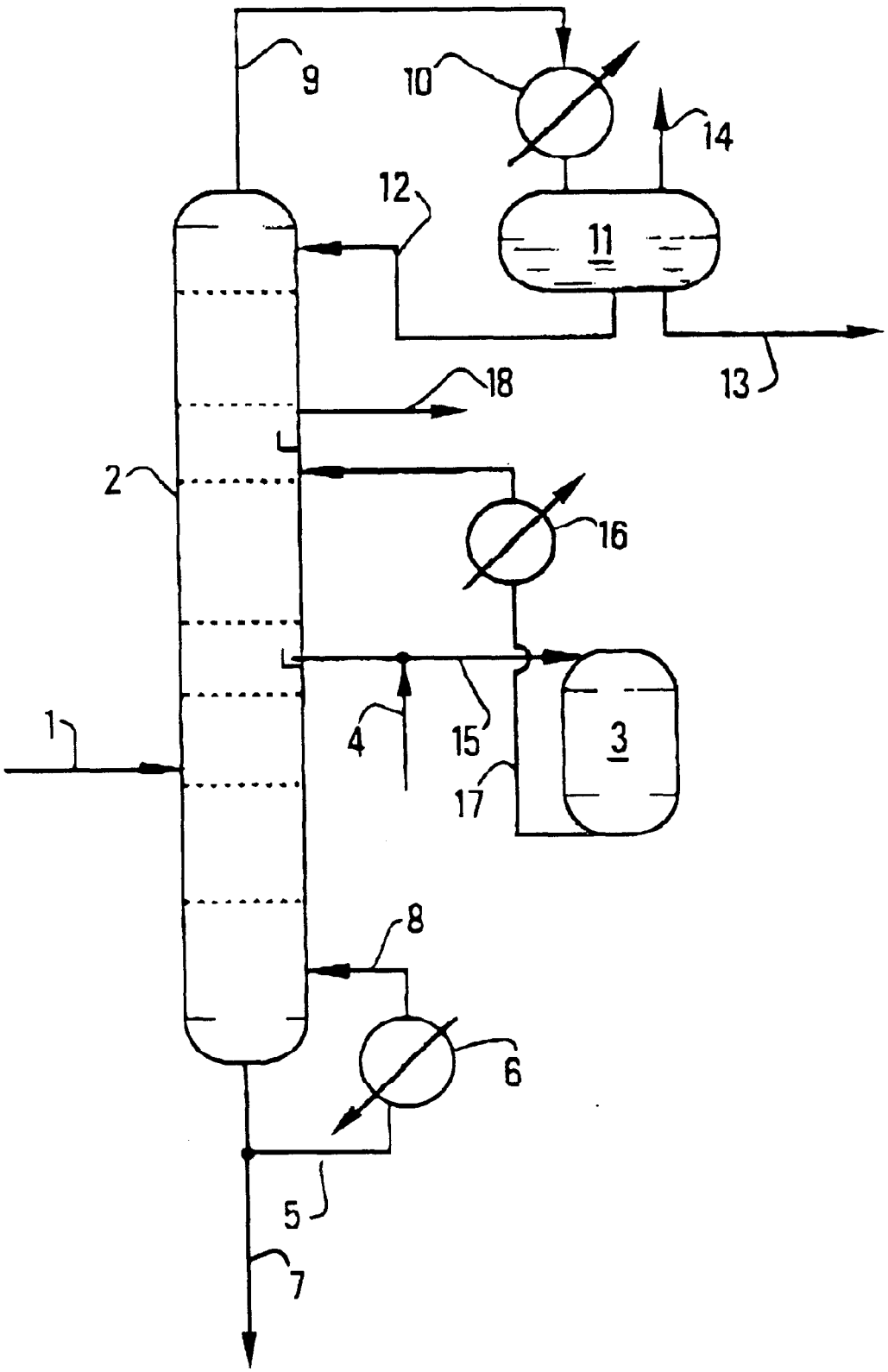
FIG. 1 represents the prior art process, i.e., without re-contacting between the vapor distillate and the feed from the column.

Thus the process of the invention comprises recycling at least a fraction of the vapor distillate which is recovered overhead from the distillation zone, then bringing it into contact with the hydrocarbon feed for the distillation zone.

The Applicant has discovered that re-contacting at least a portion of the vapor distillate with at least a portion of the feed introduced into the distillation zone will in particular enable the light compounds partially originating from the hydrocarbon feed to be converted to be recycled, said light compounds possibly being directly recovered with the desired products.

Further, the process of the invention allows for operation with a lower reboiling duty for the distillation zone than for prior art processes.

Applied to benzene hydrogenation, the process of the invention is, for example, a process for treating a feed, the major portion of which is constituted by hydrocarbons containing at least 5, preferably 5 to 9 carbon atoms per molecule, and comprising at least one unsaturated compound, comprising benzene and possibly olefins, in which said feed is treated in a distillation zone associated with a hydrogenation reaction zone which is at least partially external and comprises at least one catalytic bed, in which hydrogenation of at least a portion of the unsaturated compounds contained in the feed, containing at most six carbon atoms per molecule, i.e., containing up to six (inclusive) carbon atoms per molecule, is carried out in the presence of a hydrogenation catalyst and a gas stream comprising hydrogen, preferably in the major portion, the feed for the reaction zone being drawn off from the height of a draw-off level and representing at least a portion, preferably the major portion, of the liquid flowing in the distillation zone, at least a portion, preferably the major portion, of the effluent from the reaction zone being re-introduced into the distillation zone at the height of at least one re-introduction level, so as to ensure continuity of distillation, and so that a distillate which is highly depleted in unsaturated compounds is recovered, said process being characterized in that at least a portion of the vapor distillate is re-contacted with at least a portion of the feed introduced into the distillation zone.

The particular application of the process of the invention to a process for reducing the benzene content in a hydrocarbon feed enables a reformate which is depleted in benzene or, if necessary, which is almost completely free of benzene and other unsaturated hydrocarbons containing at most six carbon atoms per molecule such as light olefins to be produced from a crude reformate, with no significant loss of the major portion of compounds containing 5 carbon atoms initially present in the crude reformate. The process of the invention thus allows the compounds containing 5 carbon atoms to be recycled by re-contacting the vapor distillate with the feed for the distillation zone.

The vapor distillate fraction which is re-contacted at least in part with a portion of the feed introduced into the distillation zone originates from a zone for separating a distillate overhead, after condensing the overhead distillate in a heat exchange zone, said separating zone producing at least one vapor distillate, re-contacted at least in part with the feed for the distillation zone, and at least one liquid fraction at least a portion of which can be returned to the head of the distillation zone as a reflux, a further portion of the liquid fraction possibly being recovered.

In the process of the invention, the mixture comprising the vapor distillate re-contacted at least in part with the feed for the distillation zone is freed of at least a portion of its lightest components before it is introduced into the distillation zone. Thus at least a portion of the light components is separated using at least one gas-liquid separation zone, for example in the form of a gas purge. Gas-liquid separation in the form of a purge for separating the lightest compounds is carried out after re-contacting the vapor distillate with the feed for the distillation zone. Thus gas-liquid separation in the form of a purge can eliminate the major portion of the light compounds introduced with the fluid comprising hydrogen necessary for the conversion reaction carried out in the reaction zone. Assuming that the feed for the distillation zone contains light compounds, the purge can also eliminate the major portion of said light compounds. In general, the re-contacted vapor distillate—feed for the distillation zone ensemble is cooled before proceeding to gas-liquid separation.

When applying the process to reducing the benzene content of a reformate, the major portion of the purge is constituted by light compounds containing up to 4 carbon atoms (inclusive) per molecule.

The invention comprises re-contacting at least a portion of the vapor distillate with the feed for the distillation zone then introducing the feed—vapor distillate mixture (free of the major portion of the light compounds) into the distillation zone. Thus at least a portion of the liquid fraction from the gas-liquid separation zone is introduced into the distillation zone.

The process of the invention comprises a step for bringing at least a portion of the vapor distillate into contact with the feed for the distillation zone carried out at a pressure which is slightly lower than the pressure of said vapor distillate, which has the advantage of not requiring a compression means to recycle the vapor distillate towards the distillation zone. Recycling the vapor distillate to the distillation zone using the process of the invention comprising re-contacting dissolves the light products of the vapor distillate in the heavy products contained in the feed for the distillation zone.

The re-contacting of the invention avoids the loss of useful hydrocarbon compounds, for example for the gasoline pool. More particularly, for benzene hydrogenation, the process can avoid losses of compounds containing 5 carbon atoms. The major portion of the vapor distillate from the column head is constituted by compounds containing up to 5 carbon atoms and thus at least a portion of it contains compounds containing 5 carbon atoms, entrained in the vapor distillate by lighter gases contained in the effluent comprising hydrogen introduced into the reaction zone associated with the distillation zone. Thus re-contacting the vapor distillate with the feed, enchained with a light gas purge step, i.e., mostly gases containing up to 4 carbon atoms per molecule (inclusive) can recover a cut of compounds containing 5 carbon atoms per molecule, which is a very important product in a fuel composition, in particular gasoline fuels.

Further, in a preferred implementation of the process of the invention, the process comprises a stabilization zone. A liquid distillate is extracted from the distillation zone from a recovery level beneath that for recovering the vapor distillate. Thus the desired product is recovered as a stabilized liquid distillate, i.e., free of the major portion of excess hydrogen and at least a portion of the light gases which are recovered in the vapor distillate. Such distinct liquid distillate recovery can eliminate gases other than the hydrogen present in the gas stream comprising mainly hydrogen introduced into the reaction zone to carry out the conversion reaction via the gaseous distillate.

Thus, for example, this preferred implementation in its particular application of benzene hydrogenation can directly recover, by withdrawal from the distillation zone, a stabilized liquid distillate in which at least partial selective hydrogenation of benzene and any other unsaturated compound containing at most six carbon atoms per molecule and other than benzene which may be present in the feed has been carried out, while limiting hydrogenation of $C_7^+$ compounds (i.e., containing at least seven carbon atoms per molecule).

When hydrogenating benzene, the stabilized liquid distillate essentially contains liquid compounds containing at least 5 carbon atoms and which can be directly used as fuels.

In a further implementation of the invention, the process comprises at least one withdrawal of a distillate which is at least partially treated in a splitter, at least part of the gaseous effluent being re-introduced into the distillation zone and the liquid effluent being recovered as an intermediate cut.

In the application of the process of the invention to reducing the benzene content in a hydrocarbon cut, the intermediate cut recovered in this implementation is a naphtha cut containing less than about 10% of benzene.

Regarding the external reaction zone, the level of re-introduction of the feed at least partially converted in the external reaction zone is generally located substantially below or substantially above or substantially at the same height of at least one draw-off level, preferably said level for drawing off the feed for the distillation zone. Preferably, the re-introduction level is located above the draw-off level.

The distillation zone generally comprises at least one column provided with at least one distillation contact means selected from the group formed by plates, bulk packing and structured packing, as is well known to the skilled person, such that the total global efficiency is equal to at least five theoretical plates. In cases known to the skilled person where using a single column can cause problems, it is preferable to split the zone and use two columns which, placed end to end, produce said zone.

The feed is introduced into the distillation zone at at least one introduction level located below the level for drawing off liquid towards the reaction zone, generally at a level of 2 to 40 theoretical plates and preferably 2 to 20 theoretical plates below the level for drawing off liquid towards the reaction zone, the draw-off level under consideration being the lowest.

The reaction zone generally comprises at least one catalytic bed, preferably 1 to 4 catalytic bed(s); when at least two catalytic beds are incorporated into the distillation zone, these two beds may be separated by at least one distillation contact means.

In the particular application of the process of the invention to the selective reduction of the amount of light unsaturated compounds comprising benzene and possibly olefins from a hydrocarbon cut, the reaction zone is a hydrogenation zone. In this case, the hydrogenation reaction zone carries out at least partial hydrogenation of benzene present in the feed, generally such that the benzene content in the stabilized liquid distillate is a maximum of a certain value, and said reaction zone hydrogenates at least part, preferably the major part, of any unsaturated compound containing at most six carbon atoms per molecule and other than benzene, which may be present in the feed.

The reaction zone is at least partially external to the distillation zone. Generally, the process of the invention includes 1 to 6, preferably 1 to 4 draw-off level(s) which supply the external portion of the zone. A portion of the external portion of the reaction zone which is supplied by a given draw-off level, if the external portion of the reaction zone comprises at least two draw-off levels, generally comprises at least one reactor, preferably a single reactor.

Since the reactor is at least partially external, a flow of liquid is drawn from the column which is equal to, greater than or less than the liquid traffic in the distillation zone located below the draw-off level for the feed to be converted.

In the particular application of converting feeds with a rather high benzene content, for example over 3% by weight, the flow rate of liquid drawn off is preferably equal to or greater than the liquid traffic in the distillation zone located below the draw-off level.

In the particular application of converting a feed for the distillation zone with a rather low benzene content, for example a content of less than about 3% by weight, the flow rate of liquid drawn off is preferably equal to or less than the liquid traffic in the distillation zone located below the draw-off level.

The process of the invention can convert a large portion of the compound(s) to be converted external to the distillation zone, possibly under pressure and/or temperature conditions which are different from those used in the distillation zone.

The process of the invention is such that the flow of liquid to be converted is generally co-current to the flow of the gas stream comprising hydrogen for all catalytic beds in the external portion of the reaction zone.

In a preferred implementation of the process of the invention, the reaction zone is completely external to the distillation zone. When the external portion of the reaction zone comprises at least two catalytic beds, each catalytic bed is supplied by a single draw-off level, preferably associated with a single re-introduction level, said draw-off level being distinct from the draw-off level which supplies the other catalytic bed(s).

In a preferred implementation of the process of the invention, the feed to be converted drawn off from the distillation zone towards the reaction zone is cooled before it enters the reactor. The converted feed leaving the reactor can be cooled before re-introducing it into the distillation zone. This cooling creates a circulating reflux. In fact, in the context of the present description, the term "circulating reflux" means a circulation of a liquid drawn off from the distillation zone at one level and re-introduced to a higher level at a temperature which is lower than the temperature of the liquid at the draw-off level.

In the particular case of reducing the benzene content in a hydrocarbon cut, one preferred implementation of the invention is such that the level of re-introducing the hydrogenated feed into the column is located above the level for drawing off the feed to be hydrogenated, to a zone where the benzene content is the lowest. More preferably, the re-introduction level is located at least 2 theoretical plates above the draw-off level and more preferably still, the level for re-introducing the feed is located at least 4 theoretical plates above the draw-off level for said feed.

In order to carry out hydrogenation in a particular application of the process of the invention, the theoretical mole ratio of hydrogen necessary for the desired conversion of benzene is 3/1. The quantity of hydrogen distributed upstream of or in the hydrogenation zone is optionally in excess with respect to this stoichiometry, and this must be higher when, in addition to the benzene in the feed, any unsaturated compound containing at least six carbon atoms per molecule present in said feed must be at least partially hydrogenated.

In general, the excess hydrogen, if any, can advantageously be recovered for example using one of the techniques described below. In a first technique, the excess hydrogen leaving the splitter in the form of a gas purge after re-contacting is recovered then can be compressed and re-used in a reaction zone. In a second technique, the excess hydrogen which leaves the splitter in the form of a purge is recovered, then injected upstream of the compression steps associated with a catalytic reforming unit, mixed with hydrogen from said unit, said unit preferably operating at low pressure, i.e., generally at an absolute pressure of less than 0.8 MPa.

The hydrogen included in the gas stream, used, for example, in the particular process of the invention for hydrogenating unsaturated compounds containing at most six carbon atoms per molecule, can originate from any source producing at least 50% by volume pure hydrogen, preferably at least 80% by volume pure hydrogen and more preferably at least 90% by volume pure hydrogen. As an example, the hydrogen from catalytic reforming processes, methanation, PSA (pressure swing adsorption), electrochemical generation or steam cracking can be cited.

One preferred implementation of the process of the invention, which may or may not be independent of the preceding implementations, is such that the effluent from the bottom of the distillation zone is at least partially mixed with the liquid distillate, preferably a stabilized liquid distillate, i.e., recovered from a withdrawal level located below the vapor distillate recovery level. In the particular case when reducing the benzene content, the mixture obtained can be used as a fuel either directly, or by incorporation into fuel fractions.

When the reaction zone is partially internal to the distillation zone, the operating conditions for the portion of the reaction zone internal to the distillation zone are linked to the operating conditions for the distillation step. Distillation is carried out at an absolute pressure which is generally in the range 0.1 MPa to 2.5 MPa with a reflux ratio in the range 0.1 to 20. The temperature in the distillation zone is in the range 10° C. to 300° C. In general, the liquid to be converted is mixed with a gas stream comprising hydrogen the flow rate of which is equal to at least the stoichiometry of the conversion reactions carried out and is at most equal to the flow rate corresponding to 10 times the stoichiometry. In the external portion of the reaction zone, the catalyst is located in every catalytic bed using any technology which is known to the skilled person under operating conditions (temperature, pressure, . . . ) which may or may not be independent, preferably independent, of the operating conditions of the distillation zone. In the portion of the reaction zone external to the distillation zone, the operating conditions are generally as follows. The absolute pressure required is generally in the range 0.1 to 6 MPa. The operating temperature is generally in the range 30° C. to 400° C. The space velocity in said reaction zone, calculated with respect to the catalyst, is generally in the range 0.5 to 60 $h^{-1}$ The flow rate of hydrogen corresponding to the stoichiometry of the conversion reactions carried out is in the range 1 to 10 times said stoichiometry.

In the particular case of hydrogenating benzene and other unsaturated compounds, the operating conditions are as follows. When the hydrogenation zone is partially internal to the distillation zone, the operating conditions for the portion of the hydrogenation zone internal to the distillation zone are linked to the operating conditions for the distillation step. Distillation is carried out at an absolute pressure generally in the range 0.2 to 2 MPa, preferably in the range 0.4 to 1 MPa, with a reflux ratio in the range 0.1 to 10, preferably in the range 0.2 to 2. The temperature at the head of the zone is generally in the range 30° C. to 180° C. and the temperature at the bottom of the zone is generally in the range 120° C. to 280° C. The hydrogenation reaction is carried out under conditions which are most generally intermediate between those established at the head and at the bottom of the distillation zone, at a temperature in the range 100° C. to 200° C., preferably in the range 120° C. to 180° C., and at an absolute pressure in the range 0.2 to 3 MPa, preferably in the range 0.4 to 2 MPa. The liquid undergoing hydrogenation is mixed with a gas stream comprising hydrogen the flow rate of which depends on the concentration of benzene in said liquid and, more generally, on the concentration of the unsaturated compounds containing at most six carbon atoms per molecule in the feed for the distillation zone. The hydrogen flow rate is generally equal to at least the flow rate corresponding to the stoichiometry of the hydrogenation reactions carried out (hydrogenation of benzene and other unsaturated compounds containing at most six carbon atoms per molecule, in the hydrogenation feed) and at most equal to the flow rate corresponding to 10 times the stoichiometry, preferably in the range 1 to 6 times the stoichiometry, more preferably in the range 1 to 3 times the stoichiometry. In the portion of the hydrogenation zone external to the distillation zone, the operating conditions are generally as follows. The absolute pressure required for this hydrogenation step is generally in the range 0.1 to 6 MPa absolute, preferably in the range 0.2 to 5 MPa and more preferably in the range 0.5 to 3.5 MPa. The operating temperature in the hydrogenation zone is generally in the range 100° C. to 400° C., preferably in the range 120° C. to 350° C. and more preferably in the rang 140° C. to 320° C. The space velocity in said hydrogenation zone, calculated with respect to the catalyst, is generally in the range 1 to 60 and more particularly in the range 1 to 40 $h^{-1}$ (volume flow rate of feed per volume of catalyst). The hydrogen flow rate corresponding to the stoichiometry of the hydrogenation reactions carried out is in the range 1 to 10 times said stoichiometry, preferably in the range 1 to 6 times said stoichiometry and more preferably in the range 1 to 3 times said stoichiometry. However, the temperature and pressure conditions can also be comprised between those which are established at the head and at the bottom of the distillation zone in the process of the present invention.

The temperature of the re-contacted vapor distillate—feed for the distillation zone mixture after cooling is in the range 10° C. to 60° C. (for example in the case of cooling with water or air) and the pressure is in the range 1 Pa to 3 MPa.

In the context of the present description, the term "reflux ratio" means the ratio of the mass flow rate of the reflux to the mass flow rate of the supply to the column.

In the particular case when the reaction zone is a zone for hydrogenating benzene and possible olefins, the catalyst used in the hydrogenation zone generally comprises at least one metal selected from group VIII, preferably selected from the group formed by nickel and platinum, used as it is or, preferably, deposited on a support. At least 50% of the metal must generally be in its reduced form. However, any other hydrogenation catalyst which is known to the skilled person can also be used.

When using nickel, the proportion of nickel with respect to the total catalyst weight is in the range 5% to 70%, more particularly in the range 10% to 70%, and preferably in the range 15% to 65%. Further, the average nickel crystallite size in the catalyst is less than $100\times10^{-10}$ m, preferably less than $80\times10^{-10}$ m, more preferably less than $60\times10\times10^{-10}$ m.

The support is generally selected from the group formed by alumina, silica-aluminas, silica, zeolites, activated charcoal, clays, aluminous cements, rare earth oxides and alkaline-earth oxides, used alone or as a mixture. Preferably, a support based on alumina or silica is used, with a specific surface area in the range 30 to 300 $m^2/g$, preferably in the range 90 to 260 $m^2/g$.

Figure 2:
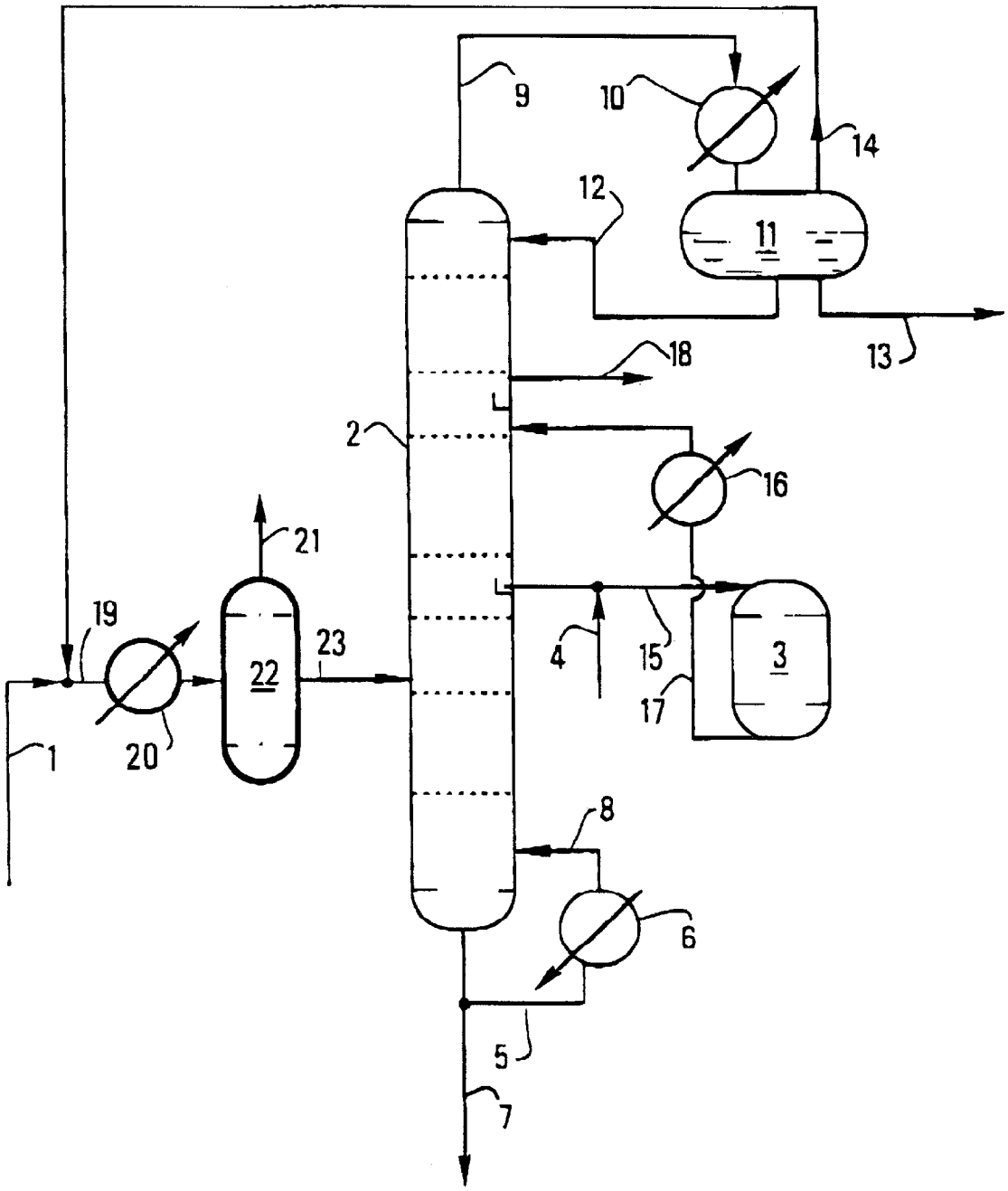
FIG. 2 constitutes an implementation of the process of the invention. Similar means are represented by the same numerals in the two figures.

FIG. 1 represents the prior art process, i.e., without re-contacting between the vapor distillate and the feed from the column. FIG. 2 constitutes an implementation of the process of the invention. Similar means are represented by the same numerals in the two figures.

The hydrocarbon feed is sent to a column 2 via a line 1. Said column contains distillation contact means, which are plates or packing, for example, partially represented by dotted lines in FIGS. 1 and 2.

At the foot of the column, the least volatile fraction of the reformate is recovered via a line 5, a portion is reboiled in exchanger 6 and a portion is evacuated via a line 7. The reboiling vapor is re-introduced into the column via a line 8. The stabilized liquid distillate is extracted via a line 18; the vapor distillate is sent to a condenser 10 via a line 9 then to a drum 11 from which the vapor distillate is extracted via a line 14. A portion of the liquid phase from drum 11 is returned via a line 12 to the head of the column as a reflux, and a further portion of the liquid phase is recovered via a line 13.

A liquid is drawn off via a line 15 by means of a draw-off plate located in the distillation zone, and the liquid is sent to the head of a reactor 3, after adding hydrogen via a line 4. The effluent from the reactor is cooled in exchanger 16 then recycled to the column via a line 17.

In one implementation of the process of the invention, shown in FIG. 2, the process is the same as that described for FIG. 1 with the exception that at least a portion of the vapor distillate is re-contacted with the feed.

At least a portion of the vapor distillate leaving at 14 is re-contacted with the feed arriving via line 1 to form the vapor distillate—feed for the distillation zone mixture at 19. After passing through a heat exchanger 20, the lightest components are purged via line 21 in purge drum 22 and the residual effluent is sent to the column via a line 23.

The entire disclosure of all applications, patents and publications, cited above and below, and of corresponding French application 98/15791, filed Dec. 14, 1998, are hereby incorporated by reference.

The following Examples illustrate a particular application of the invention, i.e., selective reduction of unsaturated compounds and benzene in a hydrocarbon cut. They were carried out by simulation using PRO/II® software from Simulation Sciences Incorporated.

EXAMPLE 1

Comparative

The unit for Example 1 is shown in FIG 1.

The process comprised a column with 36 theoretical plates numbered from top to bottom (including the condenser and reboiler) with a diameter of 2.13 m.

The column comprised a draw-off point for a liquid effluent sent to a hydrogenation reactor and re-introduction of the hydrogenated feed four plates above the draw-off plate.

The vapor distillate from the column was sent to the gasoline pool.

The reflux ratio with respect to the supply (expressed by weight) was 0.654. The reflux temperature was 38° C. The reboiler duty was 6930 kW.

The process was carried out with an external hydrogenation reactor containing 3.9 $m^3$ of catalyst and operating at an absolute pressure of 2.0 MPa. The nickel catalyst is sold by PROCATALYSE under the trade reference LD746.

The feed for the column was injected to plate n°28 via line 1. The feed for reactor 3 was drawn off from plate n°12 at a temperature of 160° C. via line 15. Hydrogen was introduced via line 4 before entering into the reactor operating in downflow mode and at 2.0 MPa absolute pressure. The hydrogen gas was injected at a pressure of 2.4 MPa and at a temperature of 32° C. The hydrogen/benzene mole ratio in the fresh feed for the column was 2.33. The effluent from reactor 3 was cooled to a temperature of 100° C. then re-injected into the column via line 17 to plate n°8. The absolute pressure in the reflux drum was 0.74 MPa. The liquid distillate (light reformate) was recovered from plate n°5 via line 18 and the vapor distillate from the column head.

The simulated compositions for the liquid fraction (light reformate) (18), vapor distillate (14) and heavy reformate (17) are shown in Table 1.

EXAMPLE 2

In Accordance with the Invention

The unit for Example 2 is shown in FIG. 2.

The process comprised a column with 36 theoretical plates (including the condenser and reboiler) with a diameter of 2.13 m.

The column comprised a draw-off point for a liquid effluent sent to a hydrogenation reactor and re-introduction of the hydrogenated feed four plates above the draw-off plate.

The vapor distillate from the column recovered via line 14 was brought into contact with fresh feed arriving via line 1, the mixture (19) after cooling by heat exchanger 10 was separated in drum 22, the gas phase 21 being directed towards the gasoline pool while the liquid phase was sent via a pump to supply the column via line 23.

Re-contacting was carried out at 38° C. (after cooling) and at a pressure of 0.7 MPa.

The reflux ratio with respect to the supply (expressed by weight) was 0.561. The reflux temperature was 38° C. The reboiler duty was 6640 kW.

The process was carried out with an external hydrogenation reactor containing 3.9 $m^3$ of catalyst and operating at an absolute pressure of 2.0 MPa. The nickel catalyst is sold by PROCATALYSE under the trade reference LD746.

The liquid distillate (light reformate) was recovered at plate n°5 via line 18 and the vapor distillate was recovered from the column head. The feed for the column was injected via line 23 to plate n°28. The feed for reactor 3 was drawn off from plate n°12 at a temperature of 156° C. via line 15. Hydrogen was introduced via line 4 before entering the reactor operating in downflow mode and at 2.0 MPa absolute pressure. The hydrogenated gas was injected at a pressure of 2.4 MPa and at a temperature of 32° C. The hydrogen/benzene mole ratio in the fresh feed was 2.34. The effluent from reactor 3 was cooled to a temperature of 100° C. then re-injected into the column via line 17 to plate n°8. The absolute pressure in the reflux drum was 0.74 MPa.

The simulated compositions of the liquid fraction (light reformate) (18), vapor distillate (14), purge vapor (21) and heavy reformate (7) are shown in Table 2.

EXAMPLE 3

Comparison of Performances

The performances of the processes described in Examples 1 and 2 are described in Table 3.

The process of the invention (Example 2) can recover light products containing at least 4 carbon atoms per molecule in the reformate mixture and heavy reformate for the same quantity of residual benzene. Measurement of the Reid vapor pressure (RVP) showed that the RVP in the case of the invention was higher than the RVP measured in the comparative Example, i.e., that the mixture of reformates in the process of the invention contained more light compounds. The C4+ losses in the case of the invention were only 83 kg/h as opposed to 496 kg/h in the prior art case.

Further, the process of the present invention can reduce the reboiler duty which was 640 kW as opposed to 6930 kW in the case of Example 1.

The process of the invention can thus, unexpectedly, recover a portion of the light products in the gasoline pool for example, with the same benzene conversion while reducing the reboiler duty.

TABLE 1

Composition of feed and effluents for Example 1 (no re-contacting)

| Substance/Kmoles/h | Fresh feed | $H_2$ | Vapor distillate | Light reformate | Heavy reformate |
|---|---|---|---|---|---|
| $H_2$ | 0.00 | 72.87 | 0.15 | 0.00 | 0.00 |
| Methane | 0.00 | 12.67 | 12.66 | 0.02 | 0.00 |
| Ethane | 0.00 | 6.22 | 6.14 | 0.07 | 0.00 |
| Propane | 0.00 | 2.64 | 2.54 | 0.10 | 0.00 |
| Butanes | 6.05 | 0.33 | 4.70 | 1.68 | 0.00 |
| Iso-pentanes | 24.77 | 0.10 | 2.21 | 22.66 | 0.00 |
| Normal pentane | 18.43 | 0.04 | 0.76 | 17.87 | 0.00 |
| Dimethylbutanes | 7.09 | 0.00 | 0.02 | 7.05 | 0.01 |
| Other C6 paraffins | 28.20 | 0.00 | 0.03 | 28.05 | 0.12 |
| Hexane | 14.32 | 0.00 | 0.00 | 15.25 | 0.26 |
| C7 paraffins | 25.23 | 0.00 | 0.00 | 2.01 | 23.29 |
| C8 paraffins | 3.12 | 0.00 | 0.00 | 0.00 | 3.12 |
| C9+ paraffins | 1.30 | 0.00 | 0.00 | 0.00 | 1.30 |
| Cyclopentane | 1.21 | 0.00 | 0.01 | 1.20 | 0.00 |
| Methylcyclopentane | 1.99 | 0.00 | 0.00 | 1.82 | 0.17 |
| Cyclohexane | 0.20 | 0.00 | 0.00 | 15.88 | 8.06 |
| Methylcyclohexane | 1.65 | 0.00 | 0.00 | 0.00 | 1.68 |
| C8 naphthenes | 0.47 | 0.00 | 0.00 | 0.00 | 0.47 |
| Pentenes | 0.45 | 0.00 | 0.03 | 0.26 | 0.00 |
| Hexenes | 1.31 | 0.00 | 0.00 | 0.10 | 0.02 |
| Heptenes | 0.96 | 0.00 | 0.00 | 0.00 | 0.89 |
| Benzene | 31.23 | 0.00 | 0.00 | 1.95 | 5.54 |
| Toluene | 128.76 | 0.00 | 0.00 | 0.00 | 128.73 |

TABLE 1-continued

Composition of feed and effluents for Example 1 (no re-contacting)

| Substance/Kmoles/h | Fresh feed | $H_2$ | Vapor distillate | Light reformate | Heavy reformate |
|---|---|---|---|---|---|
| C8 aromatics | 138.11 | 0.00 | 0.00 | 0.00 | 138.11 |
| C9+ aromatics | 73.58 | 0.00 | 0.00 | 0.00 | 73.58 |
| TOTAL | 508.42 | 94.88 | 29.27 | 115.99 | 385.33 |

TABLE 2

Composition of feed and effluents for Example 2 (re-contacting)

| Substance/ Kmoles/h | Fresh feed | $H_2$ | Purge | Vapor distillate | Light reformate | Heavy reformate |
|---|---|---|---|---|---|---|
| $H_2$ | 0.00 | 73.11 | 0.18 | 0.22 | 0.00 | 0.00 |
| Methane | 0.00 | 12.72 | 12.68 | 19.61 | 0.04 | 0.00 |
| Ethane | 0.00 | 6.24 | 5.72 | 33.96 | 0.52 | 0.00 |
| Propane | 0.00 | 2.65 | 1.45 | 26.19 | 1.21 | 0.00 |
| Butanes | 6.05 | 0.33 | 0.61 | 25.34 | 5.77 | 0.00 |
| Iso-pentanes | 24.77 | 0.10 | 0.23 | 5.35 | 24.64 | 0.00 |
| Normal pentane | 18.43 | 0.04 | 0.09 | 1.86 | 18.58 | 0.00 |
| Dimethylbutanes | 7.09 | 0.00 | 0.03 | 0.04 | 7.05 | 0.01 |
| Other C6 paraffins | 28.20 | 0.00 | 0.07 | 0.06 | 28.02 | 0.11 |
| Hexane | 14.32 | 0.00 | 0.02 | 0.00 | 15.23 | 0.24 |
| C7 paraffins | 25.23 | 0.00 | 0.02 | 0.00 | 5.13 | 20.20 |
| C8 paraffins | 3.12 | 0.00 | 0.00 | 0.00 | 0.00 | 3.12 |
| C9+ paraffins | 1.30 | 0.00 | 0.00 | 0.00 | 0.00 | 1.30 |
| Cyclopentane | 1.21 | 0.00 | 0.00 | 0.02 | 1.21 | 0.00 |
| Methylcyclopentane | 1.99 | 0.00 | 0.00 | 0.00 | 1.84 | 0.14 |
| Cyclohexane | 0.20 | 0.00 | 0.00 | 0.00 | 21.23 | 2.59 |
| Methylcyclohexane | 1.65 | 0.00 | 0.00 | 0.00 | 0.01 | 1.82 |
| C8 naphthenes | 0.47 | 0.00 | 0.00 | 0.00 | 0.00 | 0.47 |
| Pentenes | 0.45 | 0.00 | 0.00 | 0.06 | 0.25 | 0.00 |
| Hexenes | 1.31 | 0.00 | 0.00 | 0.00 | 0.11 | 0.02 |
| Heptenes | 0.96 | 0.00 | 0.00 | 0.00 | 0.00 | 0.83 |
| Benzene | 31.23 | 0.00 | 0.03 | 0.00 | 2.57 | 5.00 |
| Toluene | 128.76 | 0.00 | 0.05 | 0.00 | 0.00 | 128.52 |
| C8 aromatics | 138.11 | 0.00 | 0.02 | 0.00 | 0.00 | 138.09 |
| C9+ aromatics | 73.58 | 0.00 | 0.00 | 0.00 | 0.00 | 73.57 |
| TOTAL | 508.42 | 95.20 | 21.23 | 112.72 | 133.42 | 376.05 |

TABLE 3

Comparison of performances

| Example | 1 (comparative) | 2 (invention) |
|---|---|---|
| % volume benzene in light reformate plus heavy reformate mixture | 1.09 | 1.09 |
| RVP of same mixture (MPa) | 0.023 | 0.032 |
| Loss of C4+ for gasoline pool (kg/h) | 496 | 83 |

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A process for converting a hydrocarbon feed in which said feed is treated in a distillation ensemble comprising a distillation zone producing an overhead vapor distillate and a bottom effluent, associated with an at least partially external reaction zone, comprising at least one catalytic bed, in which at least one reaction for converting at least a portion of at least one hydrocarbon is carried out in the presence of a catalyst and a gas stream comprising hydrogen, the feed for the reaction zone being drawn off at the height of at least one draw-off level and representing at least a portion of the liquid flowing in the distillation zone, at least part of the effluent from the reaction zone being re-introduced into the distillation zone at the height of at least one re-introduction level, so as to ensure continuity of the distillation, said process being characterized in that at least a portion of the vapor distillate is re-contacted with at least a portion of the feed introduced into the distillation zone.

2. A process according to claim 1, in which the vapor distillate—feed for the distillation zone ensemble brought into contact is treated in a gas-liquid separation zone.

3. A process according to claim 2, in which at least a portion of the liquid fraction from the gas-liquid separation zone is introduced into the distillation zone.

4. A process according to claim 1, in which the level for re-introducing the effluent from the reaction zone is located above the level for drawing off the feed for the reaction zone.

5. A process according to claim 1, in which the reaction zone is completely external to the distillation zone.

6. A process according to claim 1, in which a stabilized liquid distillate is drawn off from the distillation zone at the height of at least one draw-off level, said level being located below the level for drawing off vapor distillate.

7. A process according to claim 1, in which at least one liquid distillate is drawn off from the distillation zone at the level of at least one draw-off level, at least a portion of said liquid distillate being at least partially treated in a splitter, at least a portion of the gaseous effluent being re-introduced into the distillation zone and the liquid effluent being recovered as an intermediate cut.

8. A process according to claim 1, in which distillation is carried out at an absolute pressure in the range 0.1 to 2.5 MPa with a reflux ratio in the range 0.1 to 20 and at a temperature in the range 10° C. to 300° C.

9. A process according to claim 1, in which for the portion of the conversion reaction external to the distillation zone, the absolute pressure required for this conversion step is in the range 0.1 to 6 MPa, the temperature is in the range 30° C. to 400° C., the space velocity in the conversion zone, calculated with respect to the catalyst, is generally in the range 0.5 to 60 $h^{-1}$ (volume of feed per volume of catalyst per hour) and the hydrogen flow rate is in the range one to ten times the flow rate corresponding to the stoichiometry of the conversion reactions carried out.

10. A process according to claim 1, in which a feed the major portion of which is constituted by hydrocarbons comprising at least 5 carbon atoms per molecule and comprising at least one unsaturated compound, comprising benzene and possibly at least one olefin, is treated.

11. A process according to claim 10, in which the reaction zone is a hydrogenation zone, in which at least a portion of the unsaturated compounds containing at most six carbon atoms per molecule and contained in the feed is hydrogenated in the presence of a hydrogenation catalyst.

12. A process according to claim 10, in which the major portion of the vapor distillate is constituted by compounds containing up to 5 carbon atoms.

13. A process according to claim 10, in which distillation is carried out at an absolute pressure in the range 0.2 to 2 MPa, with a reflux ratio in the range 0.1 to 70 the temperature at the head of the distillation zone being in the range 30° C. to 180° C. and the temperature at the bottom of the distillation zone being in the range 120° C. to 280° C.

14. A process according to claim 10 in which, for the portion of the hydrogenation reaction external to the distillation zone, the absolute pressure required for the hydrogenation step is in the range 0.1 to 6 MPa, the temperature is in the range 100° C. to 400° C., the space velocity in the hydrogenation zone, calculated with respect to the catalyst, is generally in the range 1 to 60 $h^{-1}$ (volume of feed per volume of catalyst per hour), and the hydrogen flow rate is in the range one to ten times the flow rate corresponding to the stoichiometry of the hydrogenation reactions carried out.

15. A process according to claim 10 in which, for the portion of the hydrogenation reaction internal to the distillation zone, the hydrogenation step is carried out at a temperature of 100° C. to 200° C., at an absolute pressure in the range 0.2 to 3 MPa, and the hydrogen flow rate supplying the hydrogenation zone is in the range one to ten times the flow rate corresponding to the stoichiometry of the hydrogenation reactions carried out.

16. A process according to claim 11, in which the major portion of the vapor distillate is constituted by compounds containing up to 5 carbon atoms.

* * * * *

UNITED STATES PATENT AND TRADEMARK OFFICE

CERTIFICATE OF CORRECTION

PATENT NO. : 6,238,549 B1
APPLICATION NO. : 09/459874
DATED : May 29, 2001
INVENTOR(S) : Jean-Charles Viltard et al.

It is certified that error appears in the above-identified patent and that said Letters Patent is hereby corrected as shown below:

Front page, (54) title, line 7, reads "BENZINE" should read -- BENZENE --
Column 14, line 22, reads "range 0.1 to 70" should read -- range 0.1 to 10 --

Signed and Sealed this

Eighth Day of May, 2007

JON W. DUDAS
*Director of the United States Patent and Trademark Office*